US005692978A

United States Patent [19]

Hummel

[11] Patent Number: 5,692,978

[45] Date of Patent: Dec. 2, 1997

[54] VOLLEYBALL BLOCK BACK DEVICE

[76] Inventor: Larry Hummel, Box 70, Sidney, Fremont County, Iowa 51652

[21] Appl. No.: 695,276

[22] Filed: Aug. 5, 1996

[51] Int. Cl.[6] ..... A63B 69/00

[52] U.S. Cl. ..... 473/459

[58] Field of Search ..... 273/411; 473/459

[56] References Cited

U.S. PATENT DOCUMENTS

| | | | |
|---|---|---|---|
| 3,602,504 | 8/1971 | Chapman et al. . | |
| 3,897,950 | 8/1975 | Keller . | |
| 4,022,471 | 5/1977 | Keller . | |
| 4,372,561 | 2/1983 | Morgan et al. . | |
| 4,842,284 | 6/1989 | Rushing | 273/411 X |
| 4,881,742 | 11/1989 | Hargreave . | |
| 5,060,946 | 10/1991 | Taylor . | |
| 5,062,646 | 11/1991 | Crist . | |
| 5,238,251 | 8/1993 | Staka . | |
| 5,460,385 | 10/1995 | Lazzeroni . | |
| 5,470,056 | 11/1995 | Dennesen | 273/411 X |
| 5,472,212 | 12/1995 | Bercan | 273/411 |

*Primary Examiner*—William H. Grieb
*Attorney, Agent, or Firm*—Suiter & Associates, PC

[57] ABSTRACT

A volleyball player training device for teaching players to hit a volleyball to different zones on an opposing team's court area, to hit over or around an opposing team's blockers, and to cover a blocked attack is disclosed. The device preferably comprises a frame having an upper frame section extending above the volleyball net and a base section which may be fastened to the volleyball net. The frame may be made of polyvinyl chloride ("PVC") pipe or the like which may be connected together so that the upper frame comprises a rectangular opening across which a netting or the like may be stretched. An attachment means such as a belt having a hook-and-loop fastener material closure or the like may be provided to attach the base section to the volleyball net.

5 Claims, 5 Drawing Sheets

VOLLEYBALL BLOCK BACK DEVICE

TECHNICAL FIELD

The present invention relates generally to athletic training devices and more particularly to training devices for developing specific skills in volleyball players.

BACKGROUND OF THE INVENTION

The sport of volleyball originated in the United States around the turn of the century. Since that time, volleyball has experienced tremendous growth in popularity and has become an important part of many collegiate and high school athletic programs as well as an Olympic sport.

A volleyball game is begun by a server hitting or serving a ball over a net to a receiving team. The receiving team then has three contacts to return the ball over the net. These three contacts will usually include a pass to the net area, a set to an attacker, and an attack which usually consists of a spike across the net, the objective being to hit the ball to the floor in the opposing teams court area. The opposing team's first line of defense to the attack is the block. The block may be formed by one, two or three players depending on the situation and the team's strategy. The object of the block is to intercept an attacked ball before, during, or immediately after it crosses the net.

An important skill that volleyball players must develop is the ability to hit the ball to different zones on the opposing team's court area during the attack. Additionally, players must be able to place the ball over or around an opposing team's blockers and to cover a blocked attack. Consequently, volleyball coaches have developed many practice drills to teach these skills to volleyball players. The effectiveness of the drills could be increased dramatically if a training aid were developed that would simulate an opposing teams blockers. However, no such training aid currently exists. Thus, it is desirable to provide a cost effective device to aid in training volleyball players to hit a volleyball to different zones on an opposing teams court area, to hit over or around an opposing team's blockers, and to cover a blocked attack.

OBJECTS OF THE INVENTION

Therefore, it is an object of the present invention to provide a device to aid in training volleyball players to hit a volleyball to different zones on an opposing teams court area. Another object of the invention to provide a device to aid in training volleyball players to hit over or around an opposing team's blockers and to cover a blocked attack. It is a further object of the invention that this device be light weight, easy to assemble and use, and inexpensive.

SUMMARY OF THE INVENTION

In accordance with these objects, the present invention provides a volleyball player training device ("block back device") for teaching players to hit a volleyball to different zones on an opposing team's court area, to hit over or around an opposing team's blockers, and to cover a blocked attack. The block back device preferably comprises a frame having an upper frame section extending above the volleyball net and a base section which may be removably fastened to the volleyball net. The frame may be made of polyvinyl chloride ("PVC") pipe or the like connected together. The upper frame may comprise a rectangular opening across which a net or the like may be stretched. An attachment means such as a belt comprising hook-and-loop fastener material or the like may be provided to attach the base section to the volleyball net.

BRIEF DESCRIPTION OF THE DRAWINGS

The numerous objects and advantages of the present invention may be better understood by those skilled in the art by reference to the accompanying figures in which.

DETAILED DESCRIPTION OF AN EXEMPLARY EMBODIMENT

Figure 1:
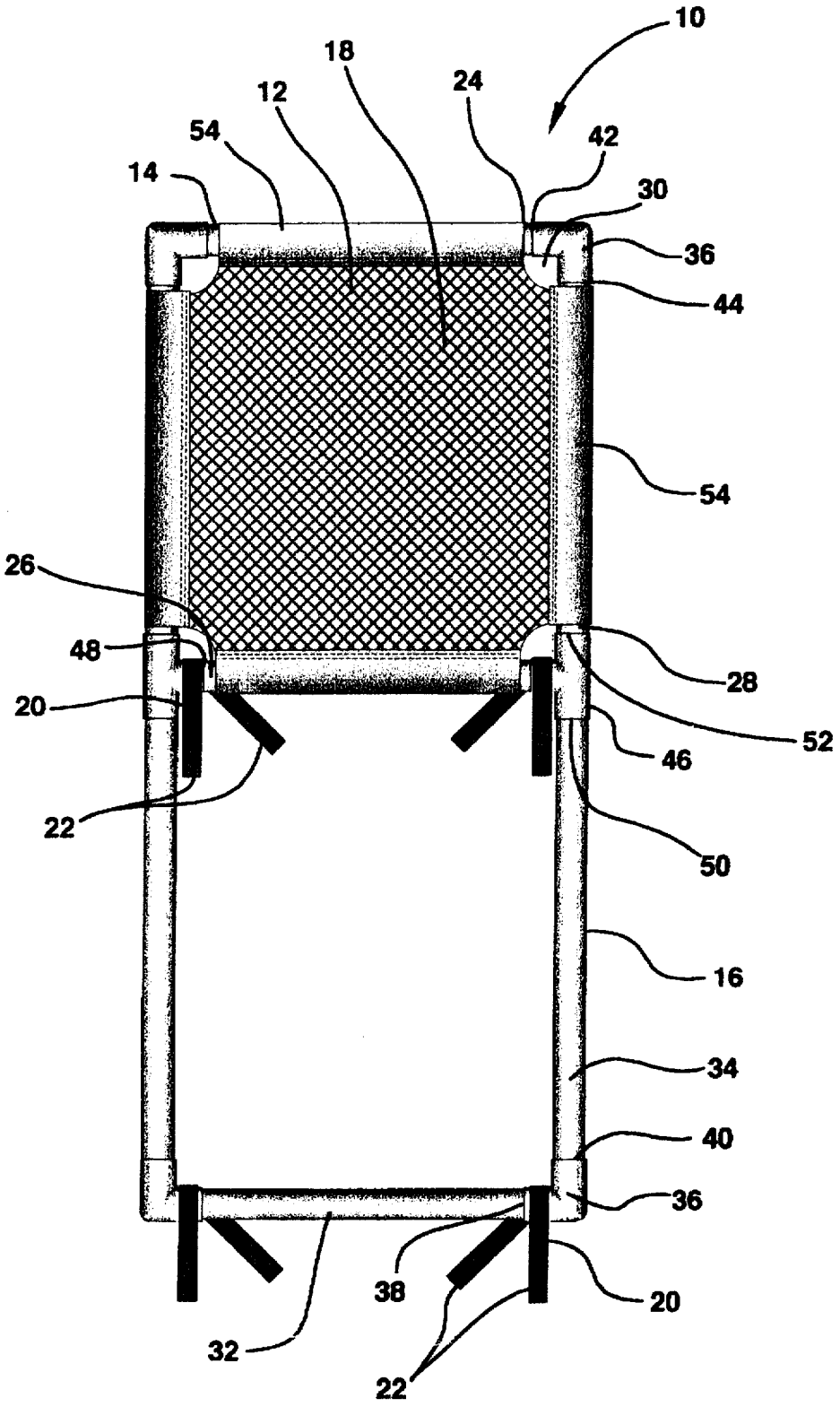
FIG. 1 is a front elevational view of a block back device according to an exemplary embodiment of the present invention.

FIG. 1 discloses a block back device 10 according to an exemplary embodiment of the present invention which is sized to simulate an opposing team's single blocker. The block back device 10 may comprise a frame 12 having an upper frame section 14 and a base section 16. The upper frame section 14 preferably extends above the volleyball net (not shown) and may have a net 18 or the like stretched across it to stop and return a volleyball. The base section 16 may have belts 20 comprising hook-and-loop fastener material 22 or the like to removably attach the block back device 10 to the upper cable and lower cord of a volleyball net (see FIG. 3).

The upper frame section 14 may be rectangular in shape and may comprise an upper horizontal member 24 spaced above and parallel to a central horizontal member 26. Distal upper frame vertical members 28 may be attached to these horizontal members 24 & 26 to form a rectangular opening 30. Similarly, the base section 16 may comprise a lower horizontal member 32 spaced below and parallel to the central horizontal member 26. These members may be attached by distal base vertical members 34. L-shaped connectors 36 may attach the ends 38 of the lower horizontal member 32 to the lower ends 40 of the base vertical members 34 and the ends 42 of the upper horizontal member 24 to the upper ends 44 of the upper frame vertical members 28. Likewise, T-shaped connectors 46 may attach the ends 48 of the central horizontal member 26 to the upper ends 50 of the base vertical members 34 and the lower ends 52 of the upper frame vertical members 28. Preferably, the frame members may be made of ¾-inch diameter polyvinyl chloride ("PVC") pipe or the like and may be attached together using an adhesive. Alternatively, the members may be removably attached together using a fastening means such as screws, bolts, a friction or interference fit, or the like.

A net 18 may be stretched across the upper frame section 14 to simulate an opposing team's blocker. This net 18 preferably comprises a mesh which may be made of nylon, cotton, hemp, plastic or the like. Alternatively a solid sheet of material made of fabric, vinyl, plastic or the like may be used instead of a net. Sleeves 54 may be sewn onto the edges of this net and may slide over the upper and central horizontal members 24 & 26 and the upper vertical members 28 such that when these members are assembled the net 18 is held taunt. Alternatively, the net may be tied to the upper frame members or attached by a means such as belts made of hook-and-loop fastener material or like materials having reusable fastening qualities.

Figure 2:
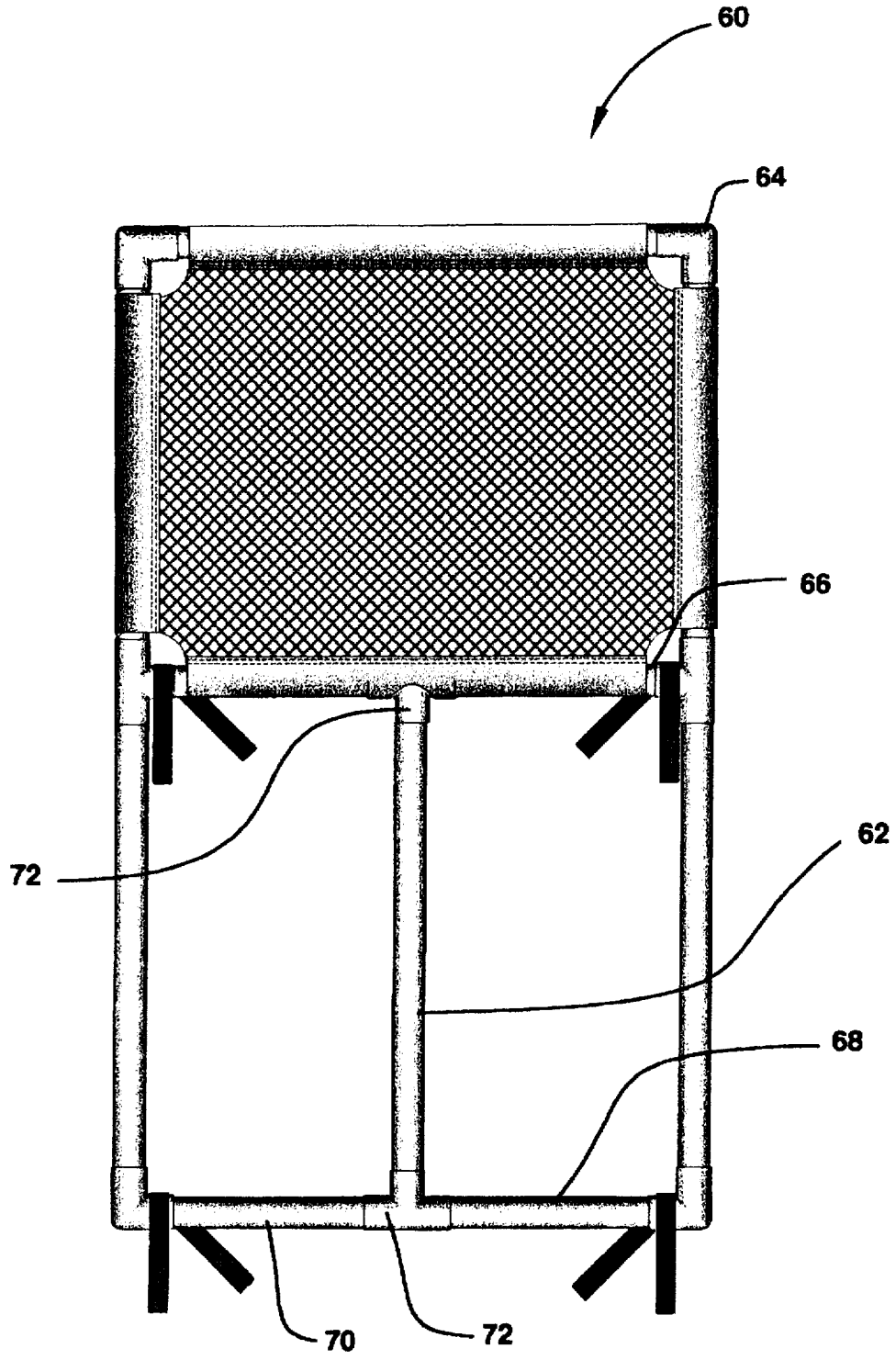
FIG. 2 is a pictorial view of a block back device according to an exemplary embodiment of the present invention which is sized to simulate a double block.

FIG. 2 is a pictorial view of a block back device 60 according to an exemplary embodiment of the present invention which is sized to simulate a double block by the players of an opposing team. This block back device is essentially identical to the embodiment disclosed in FIG. 1 except that it is widened to simulate two blockers instead of one. A third central lower vertical member 62 may be added to provide greater stiffness to the frame 64 and to provide additional points for attaching the larger block back device 60 to a volleyball net (not shown). The central and lower horizontal members 66 & 68 may be formed from two half members 70 connected by T-shaped connectors 72. The central vertical member 62 may be attached between these T-shaped connectors 72.

Although the invention is not restricted to specific dimensions, it is intended that the preferred embodiments will be attachable to a volleyball net conforming with the standards which are generally used or prescribed by volleyball rules. For example, the base section of a block back device may be approximately 36 to 39 inches high to correspond to the heights of regulation volleyball nets. An exemplary single block back device may have a width of 16 inches to simulate the reach of a single blocker. Likewise, an exemplary double block back device may have a width of 30 inches to simulate the reach of two players forming a double block. Both devices may have an upper frame section extending 30 inches over the top of the net. However, in some instances a block back device having an upper frame section extending only 20 inches over the top of the net may be preferred. For example, this embodiment may make the device easier to hit over for younger or less skilled players.

Figure 3:
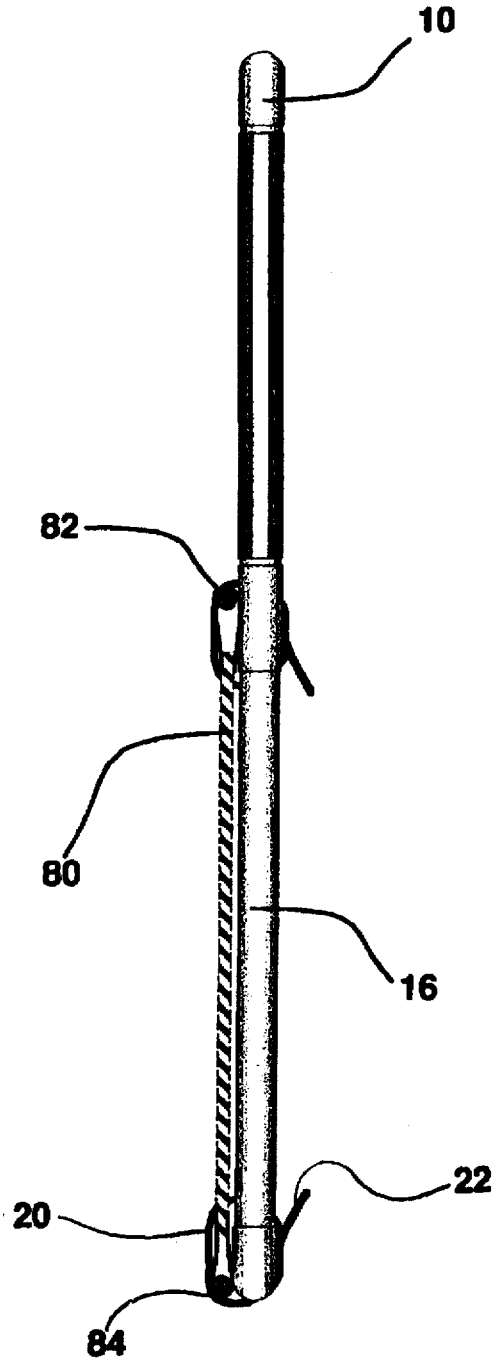
FIG. 3 is a side elevational view illustrating the attachment of a block back device according to the embodiments illustrated in FIGS. 1 and 2 to a volleyball net.

FIG. 3 illustrates the attachment of a block back device 10 to a volleyball net. The base section 16 is preferably the same height as a regulation volleyball net 80 so that it may be attached to the net's upper cable 82 and lower cord 84. In this manner, a secure, stable attachment may be provided. Belts 20 comprising hook-and-loop fastener material 22 or the like may be attached to the base section 16 at select points. These belts 20 may be wrapped around the upper cable 82 and lower cord 84 of the volleyball net 80 to removably attach the block back device 10 to the net. Alternatively, other attachment means may be used. For example, the base could be attached to the volleyball net using ropes, belts having snaps or buckles, or the like. It should also be obvious to one skilled in the art that the block back device may be made free standing instead of being attached to the volleyball net. However, this embodiment would be more expensive to manufacture and would lack the portability of the preferred embodiments described above.

Figure 4:
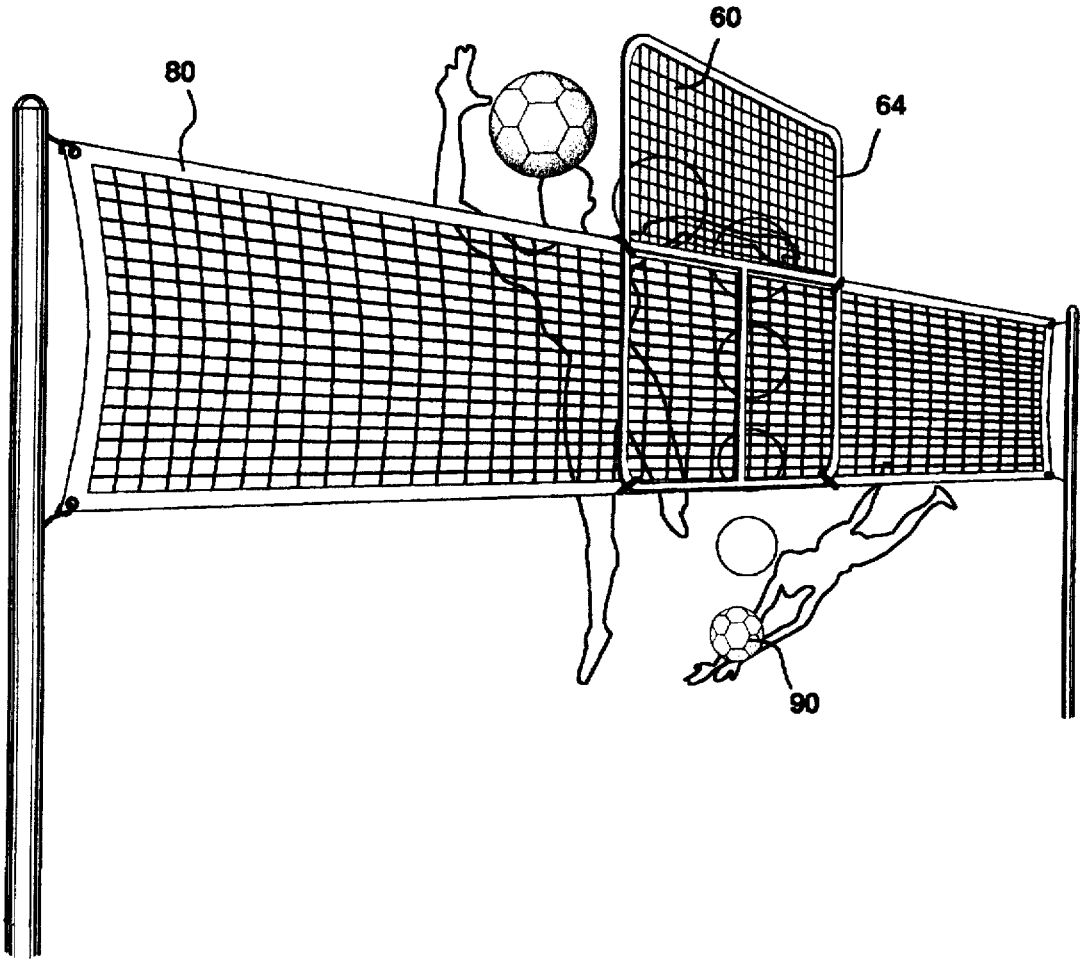
FIG. 4 illustrates the use of the block back device disclosed in FIG. 2.
Figure 5:
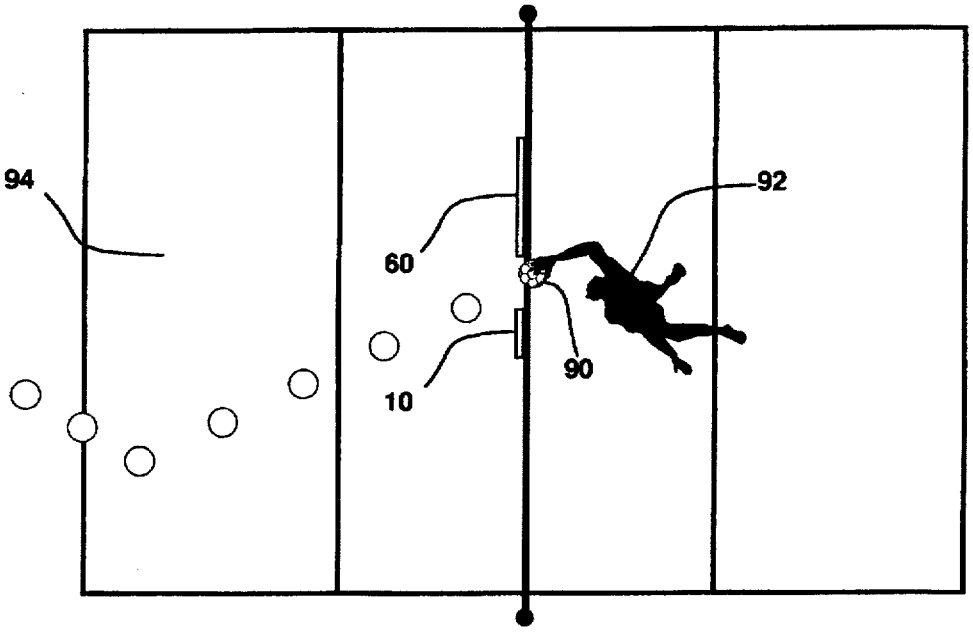
FIG. 5 is an overhead diagrammatic view of the path of a volley ball hit around block back devices according to the embodiments disclosed by FIGS. 1 and 2.
Figure 6:
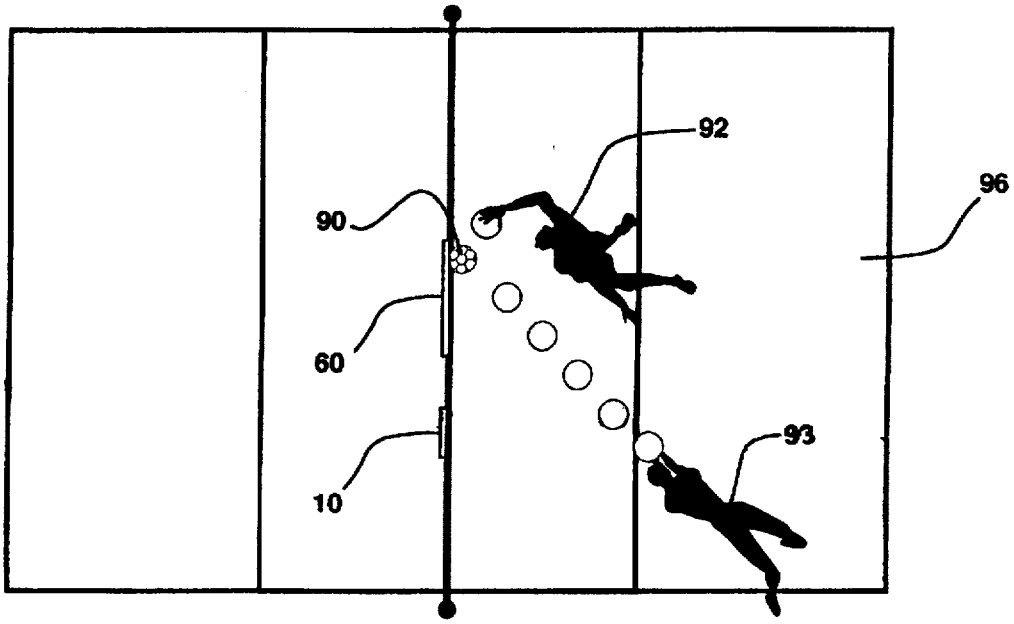
FIG. 6 is an overhead diagrammatic view of the path of a volley ball hit into one of the block back devices according to the embodiments shown in FIG. 5.

FIGS. 4, 5 and 6 illustrate the use of the block back devices 10 & 60 disclosed in FIGS. 1 and 2 to train volleyball players to hit a volleyball to different zones on an opposing team's court area, to hit over or around an opposing team's blockers, and to cover a blocked attack. As shown in FIG. 4, the block back device 60 may be attached at any point along the volleyball net 80. The upper frame section 64 may extend above the volleyball net 80 to simulate, in this case, a double block.

A typical practice drill is depicted in FIGS. 5 and 6, wherein one or more single or double block back devices 10 & 60 may be attached to the volleyball net 80. A setter (not shown) may set the volleyball 90 to an attacker 92. The attacker 92 may then attempt to hit or spike the volleyball 90 to different areas of the opposing teams court 94 (FIG. 5). If the attacker 92 fails to hit the volleyball 90 around or over the block back devices 10 & 60, the ball 90 will be "blocked" or returned back into the attacking team's court 96. The other players 98 must then be in proper defensive position to play the ball back into the air, i.e. to cover the blocked attack (FIG. 6).

In view of the above detailed description of a preferred embodiment and modifications thereof, various other modifications will now become apparent to those skilled in the art. The claims below encompass the disclosed embodiments and all reasonable modifications and variations without departing from the spirit and scope of the invention.

What is claimed is:

1. A volleyball player training device comprising:

(a) a frame wherein the periphery of said frame comprises two substantially vertical side frame members, a substantially horizontal upper frame member, and a substantially horizontal lower frame member, and wherein said frame further comprises a substantially horizontal central frame member affixed to each of said two vertical side frame members, said central frame member dividing each of the vertical side frame members into upper and lower portions;

(b) a net stretched across the opening bounded by the upper frame member, the central frame member, and the upper portion of each of the two said vertical side frame members, said net having sufficient tension to avoid entrapping a ball hit into it; and (c) attachment means for removably attaching the device to a volleyball net such that said net extends vertically above the volleyball net.

2. The volleyball player training device according to claim 1 wherein said net is attached to said frame by one or more sleeves attached to said net, said one or more sleeves being wrapped around one or more of said frame members.

3. The volleyball player training device according to claim 2 wherein said net is attached to said frame by a plurality of sleeves attached to said net.

4. The volleyball player training device according to claim 1 wherein said attachment means comprises at least one belt having a reusable hook-and-loop fastener material closure.

5. The volleyball player training device according to claim 1 wherein said frame further comprises a substantially vertical frame support post affixed to said central frame member and said lower frame member.

* * * * *